United States Patent [19]

Ohta

[11] 4,045,794

[45] Aug. 30, 1977

[54] ALARM INDICATING SYSTEM

[75] Inventor: Jun Ohta, Aichi, Japan

[73] Assignee: Toyota Jidosha Kogyo Kabushiki Kaisha, Toyota, Japan

[21] Appl. No.: 669,728

[22] Filed: Mar. 23, 1976

[30] Foreign Application Priority Data

Mar. 25, 1975 Japan ..... 50-35964
Oct. 9, 1975 Japan ..... 50-122779

[51] Int. Cl.[2] ..... G08B 19/00

[52] U.S. Cl. ..... 340/414; 340/52 F; 340/380

[58] Field of Search ..... 340/52 D, 52 F, 59, 340/366 R, 378 R, 380, 383, 412, 414, 415

[56] References Cited

U.S. PATENT DOCUMENTS

| | | | |
|---|---|---|---|
| 2,623,313 | 12/1952 | Fuchs | 340/380 |
| 2,751,584 | 6/1956 | Isborn | 340/380 |
| 2,813,266 | 11/1957 | Kay et al. | 340/380 |
| 3,150,362 | 9/1964 | Belanich | 340/380 |
| 3,611,359 | 10/1971 | Panerai | 340/380 |
| 3,728,673 | 4/1973 | Werda | 340/52 F |
| 3,839,701 | 10/1974 | Pomerantz | 340/52 F |

*Primary Examiner*—Alvin H. Waring
*Attorney, Agent, or Firm*—Stevens, Davis, Miller & Mosher

[57] ABSTRACT

An alarm indicating system, for preferred use in vehicles, having alarm legends carrying indicator elements arranged in layers, by which the occurrence of abnormalities in the operation of specific parts or objects of functional importance are located according to a predetermined order of importance given to the objects. Misreading or illegibility of alarm legends, overlapped in a display, thus is avoided. The system also incorporates a fault finder means to check instantly and automatically if the indicators or drive circuits for the indicators have failed in operation.

10 Claims, 11 Drawing Figures

ALARM INDICATING SYSTEM

The present invention relates to an improvement in an alarm indicating system comprising indicator elements and a priority assigning means, and more particularly to an improved system which is capable of performing a plurality of different kinds of alarm indications within a limited space available for indication.

With the increasing use of automatic control or monitor techniques in wide industrial fields, it has become more and more necessary to provide indicator means adapted to indicate operating conditions or changes in specific parts or objects of functional importance involved in the system to which such apparatus have been applied. Among many forms of indication, as has been generally been accepted, those in the form of letters, symbols or figures (hereinafter referred to simply as letter represented indications) are best of all suited to reliable, precise communication or showing operating conditions of many functional objects. However, this letter represented indication is usually defective in that to render those letters in a display readable distinctly, there is needed a relatively broader space for indication. Hence, the above described letter represented indicator means almost always has not been used in practice where the space available for indication is particularly limited.

As a good example of such limited space for indication, there is known indicator means installed adjacent to a driver's seat in a motor vehicle such as an automobile. It is desired that from his seat, the driver may constantly observe or monitor operating conditions of functional objects of importance incorporated in the vehicle. This device is now in use for some vehicles as a centralized alarm device. This device preferably is of a letter represented alarm type adapted to identify any functional object which has malfunctioned or is operating abnormally. However, the problem is that due to the conventional arrangement of many instruments or meters installed on the front panel of the automobile, it has been hardly practicable to secure necessary space for indication purposes to cover all functional objects or parts specified. To avoid this problem, the known device in its design employs a single indicator plate carrying thereon all of the individual alarm legends whereby those problem parts are identified upon lighting of the corresponding legends on the plate. This has made it difficult for the driver to recognize and distinguish individually those indications and may lead to serious traffic accidents especially when, while the car is running, the driver pays attention to a particular lit indication which usually is of small size letters.

There is known an improved indicator of the type adapted for many different letter represented indications within a limited space available for indication. It includes a plurality of indicating elements arranged in layers each of which elements has an indicating plate of a transparent material providing thereon light reflecting spots whose pattern of arrangement represents a particular letter or letters, and a light source on one side of the plate for lighting up the spots. With this improved structure having a plurality of layered indicating elements performing individual indications, it has been made possible to provide many indications of different kinds even within an available indicating space which is rather limited. This structure hence, is best suited as an indicator means for the centralized alarm system mentioned earlier.

Since, however, the above described indicator means is in the form of layered indicating elements in operative association with respective functional objects, it is disadvantageous in that when there occur abnormalities of two or more functional objects, respective letter represented indications all overlap so that it is hardly possible to read distinctly the individual indications. Such disadvantage occurs when two or more functional objects show abnormalities simultaneously, or two or more alarm indications are effected one immediately after another.

To settle the above problem, there has been proposed an indicator device of the type in which by having a set priority order sequence of signalling among abnormality detecting signals from the respective functional objects, only one of those indicating elements arranged in layers effects an alarm action. However, again those devices have difficulties with respect to checkups or inspections for failure of every electrical component, particularly display lamps incorporated in the device. This checkup which is very important for safety since the indicator device is used in an alarm system, is usually carried out by the trial step of lighting the individual indicating elements one after another or all at a time. However, if the checkup is made by lighting the indicating elements all at a time it is difficult or impossible to know which light source, for example, is in failure. On the other hand, if the inspection is carried out by lighting all elements one after another, then that procedure will be troublesome and time consuming because of the necessity of employing change over means such as a manual checkup switch and the like. This also may result in overlooking some defective light sources.

The invention, therefore, is directed to eliminate the prior art disadvantages described so far by providing an improved indicator device in which indicating elements are energized one after another by application of checkup signals so that the elements, particularly display lamps and circuitry components, are checked to see if any of them has failed.

The preferred embodiments of the invention will now be described by reference to the drawings, wherein.

Figure 1:
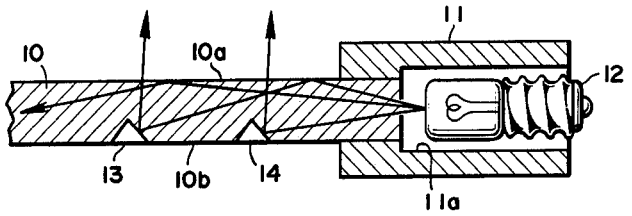
FIG. 1 is a schematic view in section of an indicator element incorporated in the invention.

FIG. 1 is a schematic view of an indicating element incorporated in an indicator device according to the invention. In this Figure, an indicating plate 10 is in the form of a transparent plate of glass or plastics particularly acrylic resins in preferred practice. The indicating plate 10 is supported at its opposite ends by support blocks 11 (only one of them is shown), and as shown, the support block 11 has an inner chamber 11*a* formed therein in which chamber a light source in the form of a display lamp 12 is fixedly mounted. The top surface 10 of the indicating plate 10 is plane as shown, but it may alternatively have a curvature. On its bottom surface 10*b* are provided light reflecting spots 13, 14 each spaced into a conical or hemispherical recession. Preferably, the extent of recession in each spot ranges from 0.2mm to 0.8mm for an indicating plate 1mm thick.

As shown by arrows in FIG. 1, light rays from the source 12 enter sidewise of the indicating plate 10. Those rays that have struck directly upon either of the two surfaces 10*a*, 10*b*, because of the plate 10 having its thickness far smaller than its length, present angles of incidence with the surfaces 10*a*, 10*b* which are greater than the critical angle of total reflection. Consequently, such light rays will all reflect upon the surfaces without being released externally of the indicating plate 10. On the other hand, those rays of light that particularly have struck upon the reflecting spots 13, 14 are reflected thereat, and then are released externally from the top surface 10*a*. Accordingly, on the top surface 10*a* of the indicating plate 10 there emerge bright flashes which can be seen and are patterned after the reflecting spots 13, 14.

Figure 2:
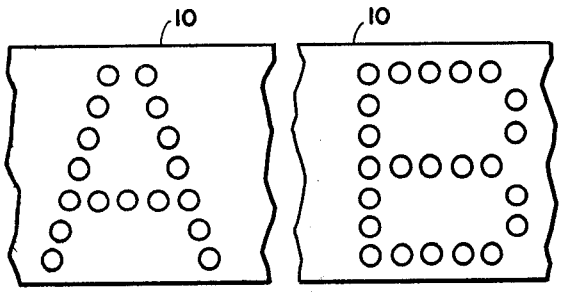
FIG. 2 is a plan view showing a display of alarm legends on the element of FIG. 1.

As is apparent from the foregoing, it is possible to display any letters or figures as desired by devising an arrangement of the reflecting spots on the bottom surface 10*b* of the plate 10. For example, FIG. 2 shows a practice in which the indicating plate 10 represents two letters A and B.

Figure 3:
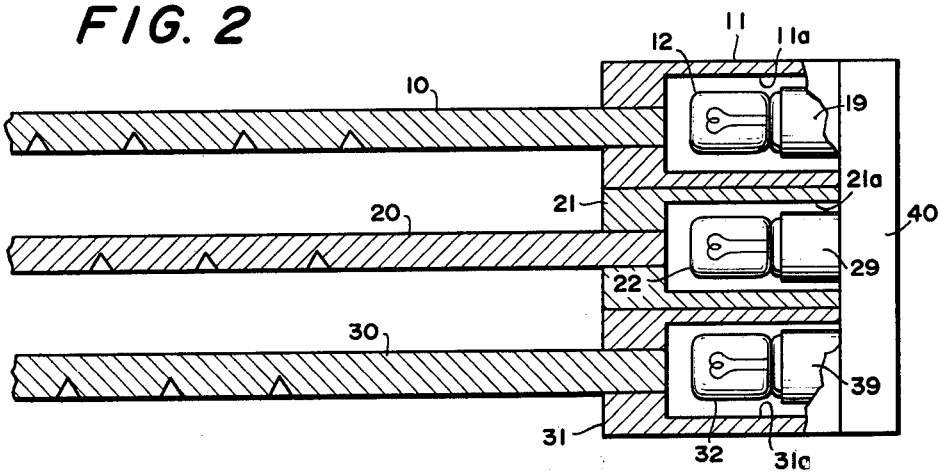
FIG. 3 is a schematic view in section of the indicating system consisting of three layered indicator elements.

In FIG. 3, there is shown the structure of an indicator device of the type including three of such indicating elements, each as described in connection with FIG. 1, disposed in a layer arrangement thereby to be capable of displaying three different insignia. Here, the display lamp 12 as a light source is mounted on a lamp holder 19 secured to a common base plate 40. Within the base plate 40 is incorporated an electric circuit (not shown) with a terminal connector through which an external power source, control circuit and the light source are interconnected. Two other elements of the same construction as the above described element are shown and a description of these therefore will be omitted except to say that similar parts are referred to with numerals 2*x* and 3*x*, respectively.

Each of the indicating elements 10, 20, 30 provides a pluraity of reflecting spots such as that described in connection with FIG. 1, which spots form a letter symbol display zone on the element. When any one of the light sources is energized, therefore, a letter symbol designed on its associated indicating plate will be in sight. For example, if the display lamp 22 is lit up, those rays of light that are reflected at the reflecting spots in the indicating plate 20 emerge from the plate 20 to the front of the indicator device through the transparent indicating plate 10. It is to be noted that the reflecting spots in the indicating plates 20 and 10 respectively are arranged somewhat offset from each other in the horizontal or vertical direction as viewed in FIG. 3 so that the light rays released from the plate 20 as described may penetrate through the plate 10 without being reflected by the spots in the plate 10.

Figure 4:
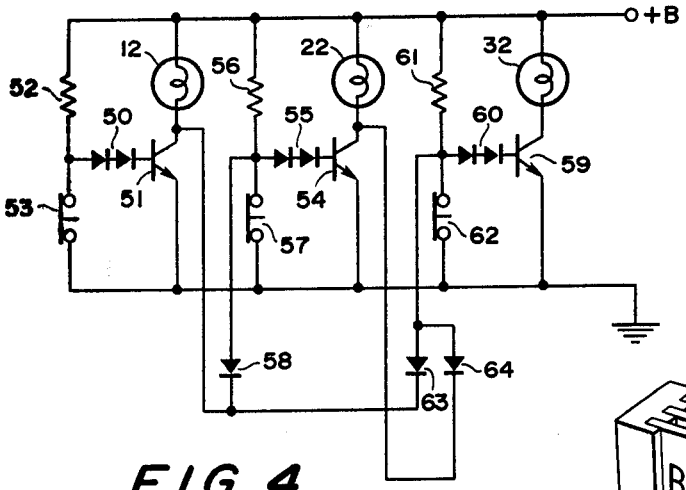
FIG. 4 is a preferred embodiment of a priority assigning circuit incorporated in the invention.

FIG. 4 shows a preferred embodiment of a priority assigning circuit incorporated in the invention. It is assumed, with parallel reference to FIG. 3, that the indicating plate 10 is for a functional object of the first importance; the plate 20 for that of second importance; and the plate 30 for that of third importance. The display lamp 12 for lighting the indicating plate 10 has one terminal connected to a power source B and the other to the collector of a transistor 51. The transistor 51 has its emitter connected to ground while its base is connected, via a diode 50, to and between an abnormality detector 53 and a resistor 52 serially connected to the power soruce B. It is arranged that the detector 53 is disposed adjacent to its associated functional object, and when the object is normal in operation or condition the detector is maintained on. Therefore, when the detector 53 is on, as shown, the base of the transistor 51 is at ground potential so that the transistor 51 is kept off whereby the display lamp 12 is maintained inactive.

In a like manner, the display lamp 22 for lighting the indicating plate 20 has one terminal connected to the power source B and the other to the collector of a transistor 54. The transistor 54 has its emitter connected to ground while its base is connected, via a diode 55, to and between a further abnormality detector 57 and a resistor 56 serially connected to the power source B. Particularly, the anode of the diode 55 is connected, via a bypass diode 58, to the collector of the first mentioned transistor 51. When a functional object associated with the detector 57 is normal in operation or condition, the detector 57 also is on as shown so that the transistor 54 is off thereby to keep the display lamp 22 inactive.

Finally, the display lamp 32 for lighting the indicating plate 30 has one terminal connected to the power source B and the other to the collector of a transistor 59. The transistor 59 has its emitter connected to ground while its base is connected, via a diode 60 to and between a still further abnormality detector 62 and a resistor 61 serially connected to the power source. Particularly, again, the anode of the diode 60 is connected, via another bypass diode 63, to the collector of the first mentioned transistor 51 while also being connected via still another bypass diode 64 to the collector of the second mentioned transistor 54. Similary, when a functional object associated with the detector 62 is in normal condition, the detector 62 is on as shown, so that the transistor 59 is off, thereby to maintain the display lamp 32 inactive.

The above described abnormality detectors are usually in the preferred form on-off type switches which may vary in design. With such switch being turned on, generally, there may be disadvantages in that due to possible incorrect or incomplete contact between the contact elements, the indicating element carries out an erroneous operation. However, the diodes 50, 55 and 60 in the present arrangement are suited to eliminate such disadvantages in a manner that even though the contact resistance in the detector happens to increase to some extent, the transistors 51, 54 and 59 will not be allowed to turn on.

The priority assigning circuit described above operates as follows. When detector 53, in the form of a switch, of the first importance of priority is turned off upon sensing abnormalities in the associated functional object, base current flows through the base of the first transistor 51 to turn on the transistor 51, so that the display lamp 12 is lit up to effect an alarm indication. At the same time, the base potentials of the second and third transistors 54, 59 respectively are limited, by way of the diodes 58, 63, to the collector potential of the first transistor 51 which is almost at ground level. In other words, the on operation of the first transistor 51 restrains the second and third transistors from action. Hence, even if the detectors 57, 62 are turned off upon sensing abnormalities while the display lamp 12 is active, the second and third transistors 54, 59 are still maintained in the off position; thus the alarm indication by the lamp 12 is not interfered with. Since the alarm indication by the lamp 12 is directed to a functional object of most importance, there is no necessity to indicate other objects of less importance. When, further, the detector 53 is turned on upon restoration of the object to normality, the transistor 51 is turned off to deenergize the lamp 12. At the same time, the collector potential of the transistor 51 is raised thereby to release the aforementioned restraining effect on the second and third transistors 54, 59. If any other detector 57 or 62 goes off upon sensing an abnormality during this period of operation, there of course takes place a different alarm by the on movement of the associated transistor 54 or 59.

Similarly, as for the detector 57 of the second priority, too, once the second transistor 54 is turned on, the third transistor 59 will be restrained from its on operation. As long as the display lamp 22 is lit, therefore, the lamp 32 will never be energized even if its associated detector 62 is turned off upon sensing abnormalities. However, it is to be noted that if, while the lamp 22 is on in this manner, the first detector 53 of top importance is turned off to turn transistor 51 on, the second transistor 54 will immediately be turned off to deenergize the lamp 22; thus, the lamp 12 instead is energized to provide an alarm indication.

Finally, regarding the detector 62 of least importance, it also can be noted that the display lamp 32 is allowed to be lit up only when the detector 62 alone is turned off because of the circuitry arrangement that the operation of the transistor 59 is restrained by the prior transistors 51, 54.

As is apparent from the foregoing description, according to the invention, it is ensured that whenever one or more detectors are off in response to the occurrence of abnormalities, a corresponding lamp of higher priority will be lit to locate such abnormality. Further, the invention preferably may incorporate in addition a first alarm device in the form of, for example, an alarm buzzer or lamp by which the occurrence of one or more abnormalities is first brought to the attention of the car driver, who then can turn his eyes to the display lamps to be able to locate that occurrence. This first alarm device may consist of an OR circuit which includes a group of diodes respectively connected to the abnormality detectors 53, 57 and 62, and an alarm circuit which is to be activated by the output of the OR circuit. In the OR circuit, it may alternatively be possible to have the diodes connected to the respective transistors 51, 54 and 59.

Figure 5:
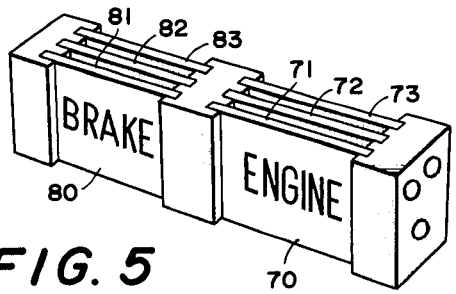
FIG. 5 is a perspective view schematically showing a further embodiment of the elements having two groups.

FIG. 5 is a further embodiment of the alarm indicating system according to the invention. As shown, there are included a first indicating section 70 having three layered indicating plates 71, 72 and 73, and a second indicating section 80 having three layered indicating plates 81, 82 and 83. All of the alarm legend carrying plates are placed in the order of importance and alternately in the two sections as shown, i.e., in the order of 71, 81, 72, 82, 73 and 83. This arrangement may overcome difficulties encountered hitherto in that only one of two or more alarm legends of substantially equal ranking in importance may be indicated.

Figure 6:
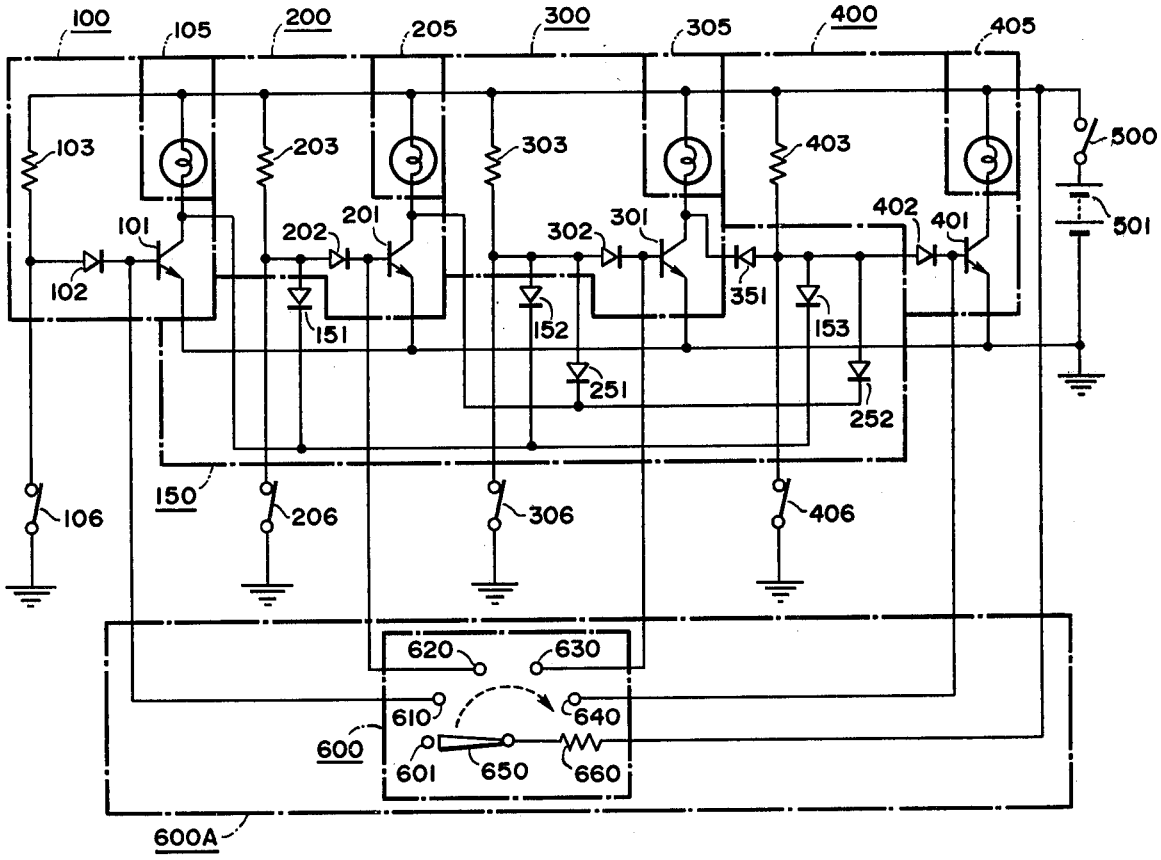
FIG. 6 is an alarm indicating system incorporating a failure checkup circuit.

In FIG. 6 there is shown a fault finder or failure checkup circuit of the manual type which has been added to the indicator system of the invention. The priority assigning circuit as shown here is composed of four drive circuits 100, 200, 300, 400, and a priority assigning diode circuit 150. The drive circuit 100 includes a transistor 101, a diode 102 and a resistor 103; and similarly the other circuits 200, 300 and 400, respectively, include transistors 201, 301 and 401, diodes 202, 302 and 402, and resistors 203, 303 and 403. To the drive circuits 100, 200, 300 and 400, are connected respective indicating elements 105, 205, 305 and 405, and abnormality detectors 106, 206, 306 and 406. The drive circuits 100, 200, 300 and 400 are all connected, through an ignition switch 500, to a battery 501. The priority assigning diode circuit 150 includes a first subcircuit of diodes 151, 152, 153, a second subcircuit of diodes 251, 252 and a third subcircuit of a diode 351. With this arrangement, the first group of diodes 151, 152, 153 serve to give first priority of operation to the drive circuit 100; the second group of diodes 251, 252 to give a second priority to the circuit 200; and the diode 351 serves to give a third priority to the circuit 300. Further details of the arrangement and mode of operation are the same as that described with reference to FIG. 4.

As shown, a failure checkup circuit 600A inclusive of a checkup switch 600 is in connection with the drive circuits 100, 200, 300 and 400. The checkup switch 600 has fixed contacts 601, 610, 620, 630, 640 and a movable contact 650. The circuit 600A is arranged so that the movable contact 650 is connected, through a resistor 660 and the aforementioned ignition switch 500, to the battery 501 while the fixed contacts 610, 620, 630 and 640, respectively, are connected to the bases of the transistors 101, 201, 301 and 401 in the drive circuits 100, 200, 300, and 400. The fixed contact 601 is used to rest the movable contact 650 at a normal position when the checkup switch 600 is not in use.

This manual type checkup circuit will operate as follows. When operating the checkup switch 600 to bring the movable contact 650 into connection with the fixed contact 610, the base of the transistor 101 comes into connection with the battery 501 through the resistor 660, thereby presenting a state of high potential. Hence, the transistor 101 is made operative to energize the indicating element 105. This energization is effected even in case the detector 106 is on or is not actuated for detection. Accordingly, if upon this trial step the indicating element 105 nevertheless remains inoperative, then it will be apparent that there is damage or fault to the element 105 including the lamp or drive circuit 100. In this manner, it is also possible to check on the other elements 205, 305, 405 and drive circuits 200, 300, 400 to make sure if they are functioning correctly, by operating the checkup switch 600 stepwise as indicated by the arrow.

However, this manual type failure checkup circuit 600A, because of many contacts involved in its switch 600, is troublesome and timeconsuming in operation, and moreover the switch 600 is very likely to be damaged frequently because of possible wear of the contact elements. To overcome the above problems, the invention provides, as shown in FIG. 7, an improved checkup switch of the single contact type in which for the earlier mentioned checkup switch 600 is substituted an electronic switching circuit.

Figure 7:
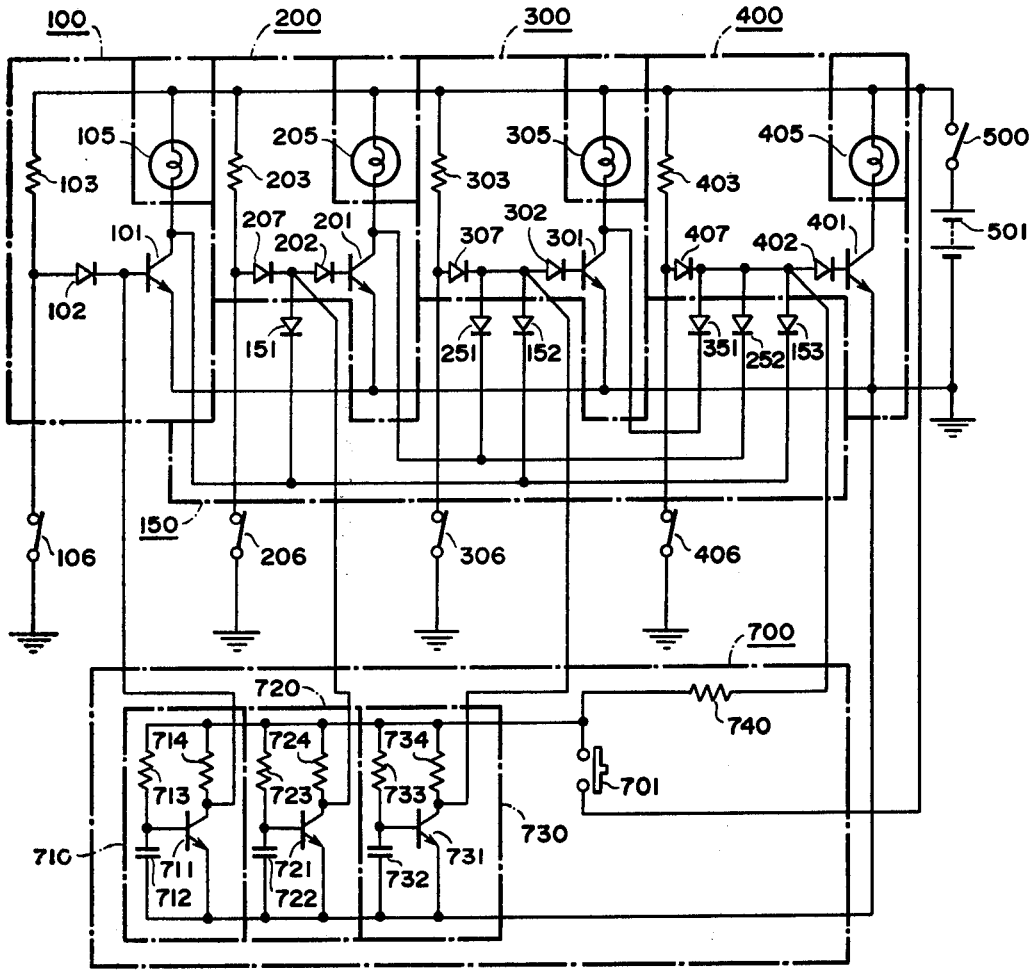
FIG. 7 is an alarm indicating system incorporating a failure checkup signaling circuit.

In FIG. 7, a checkup signaling circuit 700 includes a checkup switch 701, time delay switching circuits 710, 720, 730 and a resistor 740. The first time delay switching circuit 710 includes a transistor 711, condenser 712 and resistors 713, 714. Similarly, other time delay switching circuits 720 and 730 also include transistors 721 and 731, condensers 722 and 732, and resistors 723, 724 and 733, 734, respectively. It is arranged that these time delay circuits are turned on in the mentioned order, or from 710 first to 730 last. To state more particularly, each circuit is given a length of on-positioned hours which is determined by the RC time constant of its resistor and condenser 713/711 or 723/721 or 733/732 connected to the base of the transistor 711 or 721 or 731. The mode of operation thus is that the first switching circuit 710 first is turned on and remains on for a predetermined length of time, at the end of which the second circuit 720 is in turn put on and holds that position for a further predetermined length of time, at the end of which the third circuit 730 in turn is put on. This sequential on operation of the switching circuits is triggered by a closing of the checkup switch 701. As shown, the time delay switching circuits 710, 720, 730 are supplied with current from the battery 501 through the checkup switch 701 when the latter is closed. Further, in the first circuit 710, the collector of the transistor 711 is connected to the base of the transistor 101 in the first drive circuit 100; the collectors of the transistors 721 and 731 in the second and third circuits respectively are connected to the anodes of the diodes 202 and 302. In the base circuits of the transistors 201 and 301 are connected diodes 207 and 307, respectively, which serve to prevent counter current therethrough. The resistor 740 in the checkup signaling circuit 700 has one end connected to the battery 501 through the checkup switch 701, and the other end connected to the anode of the diode 402.

The checkup switch 701 is in the form of a push button type switch which is turned on as long as it is depressed. With the switch 701 being on, the time delay switching circuits 710, 720, 730 are supplied with current from the battery 501, through the closed switch 500 while the bases of the transistors 101, 201, 301 and 401 are supplied with current through the resistors 714, 724, 734 and 740, respectively.

Suppose, with this arrangement of FIG. 7, the ignition switch 500 is now closed so that the switching circuits are supplied with current through the checkup switch 701; as the bases of the transistors 101, 201, 301 and 401 respectively are supplied with current via resistors 714, 721, 734 and 740. In this instance, the time delay circuits 710, 720, 730 do not yet reach their on position because the respective condensers 712, 722 and 723 are being charged while the first transistor 101 in the circuit 100 is turned on upon the closing of the checkup switch 701. As regards the other transistors 201, 301, 401, however, they are turned off immediately upon this on operation of the transistor 101, because their bases come into connection with ground through the respective base connected diodes 151, 152, 153. Because of the priority assigning circuit 150, these transistors 201, 301, 401 thus maintain off positions, while the display lamp 105 is energized by the on operation of the transistor 101 and continues being lit as long as the transistor 101 is on.

After a lapse of a predetermined length of time, then, the time delay switching circuit 710 becomes on, so that the base of the transistor 101 is connected, through the transistor 711 in the time delay circuit 710, to ground. The first transistor 101 now becomes off, and the display lamp 105 is thereby deenergized. Hereupon, the other transistors 201, 301, 401 are released from the aforementioned restraining conditions of their bases being connected to ground, so that they are all ready to be able to be turned on.

However, once the second transistor 201 is turned on, the bases of the other transistors 301 and 401 respectively come into connection, through the diodes 251 and 252, to ground; thus, the transistors 301, 401 are maintained off. Meanwhile, the display lamp 205 is energized and continues its alarm as long as the transistor 201 is on or until the transistor 721 in the second time delay switching circuit 720 is turned on.

In a like manner, the lighting of the display lamps 305 and 405 will occur depending on the formation of the on conditions of the respective transistors 301 and 401. It is to be noted with respect to the fourth display lamp 405 that its energization continues until the checkup switch 701 goes off.

Figure 8:
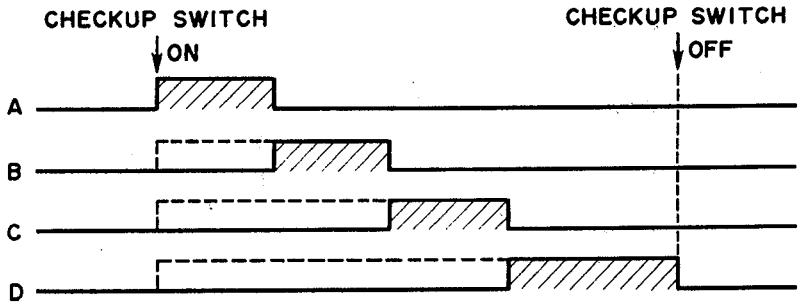
FIG. 8 is a time chart representation of the operational sequence of the system of FIG. 7.

FIG. 8 is a schematic time chart showing in wave patterns the operational sequence thus far described in which waves A, B, C and D respectively represent how the transistors 101, 201, 301 and 401 and display lamps 105, 205, 305 and 405 are activated in timed relation. As shown, upon closing of the checkup switch 701 the first transistor 101 is turned on as indicated at the forward rise or leading edge of the wave A, and is turned off as indicated at the backward rise or trailing edge as the time delay circuit 710 is turned on, upon which the second transistor 201 is turned on as indicated at the forward rise of the wave B (solid line), and is turned off at the backward rise, and so on in the other waves. The hatched sections represent the respective display lamps being energized; and the broken line sections in B, C and D show the state of the respective transistors as being triggered, but kept restrained from action by the diode circuit 150. It is noted again that the lighting of the fourth lamp 405 is continued until the checkup switch 701 is made off as indicated at the backward rise of the wave D.

Figure 9:
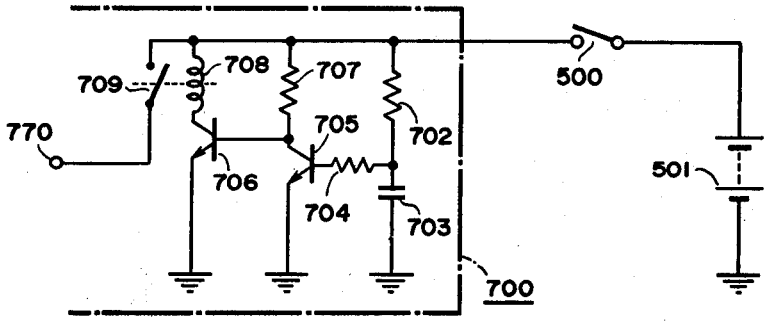
FIG. 9 is a timer circuit which may be substituted for a checkup switch of FIG. 7.

The checkup signaling circuit 700 has so far been described with its time delay switching operation being initiated by the push button type switch 701. In FIG. 9 there is shown a timer circuit 700 which upon closing of the ignition switch 500, sends checkup signals to the respective time delay switching circuits. This timer circuit includes a time constant circuit of a resistor 702 and condenser 703. The resistor 702 has one end connected through the ignition switch 500 to the battery 501. To and between the resistor 702 and condenser 703, is connected the base of the transistor 705 through a resistor 704. The collector of the transistor 705 is in connection with the base of a transistor 706 and also with the ignition switch 500 through a resistor 707. The collector of the transistor 706 is connected, through a relay coil 708, to the ignition switch 500. A relay contact 709, which is to be opened or closed by the relay coil 708, has its one end connected to the ignition switch 500 and the other end connected, through an output terminal 770 of the timer circuit 700, to the time delay switching circuits 710, 720, 730 and resistor 740 of FIG. 7.

The timer circuit thus constructed operates as follows. When the engine of the vehicle having the present invention stops, the transistors 705 and 706 are off to open the relay contact 709 so that no checkup signal is sent to the time delay switching circuits. However, when the ignition switch 500 is turned on, the respective collectors of the transistors 705 and 706 are impressed with the battery voltage. In this instance, the condenser 703 is not fully charged as yet so that the base potential of the transistor 705 does not reach the working level, the transistor 705 being kept off. Consequently, the base of the transistor 706 is impressed with the battery voltage to make the transistor 706 on. Hence, magnetizing current flows through the relay coil 708 to close the relay contact 709, so that from the terminal 770 checkup signals are sent to the time delay circuits 710, 720 and 730 of FIG. 7.

The sending of the checkup signals is continuously effected during the failure checkup operation for the indicating elements and drive circuits, and stops automatically upon completion of all the necessary checkup steps. To describe this more particularly, gradual charging is effected, through the resistor 702, to the condenser 703, so that after a predetermined charge time, the base potential of the transistor 705 is raised to the working level. Then, the transistor 705 is turned on while at the same time the base potential of the transistor 706 is lowered below the cutoff voltage thereby to turn off the transistor 706. As a result, the flow of magnetizing current through the relay coil 708 is interrupted thereby to open the relay contact 709. Hence, the sending of the checkup signals from the terminal 770 is suspended.

By selecting properly the time constant of the circuit of resistor 702 and condenser 703 in response to a given checkup time, it is possible to stop precisely and automatically the sending of checkup signals upon completion of all the checkup steps.

As is apparent from the foregoing, the invention is advantageously capable of performing checkup operations automatically upon closing of the ignition switch.

Figure 10:
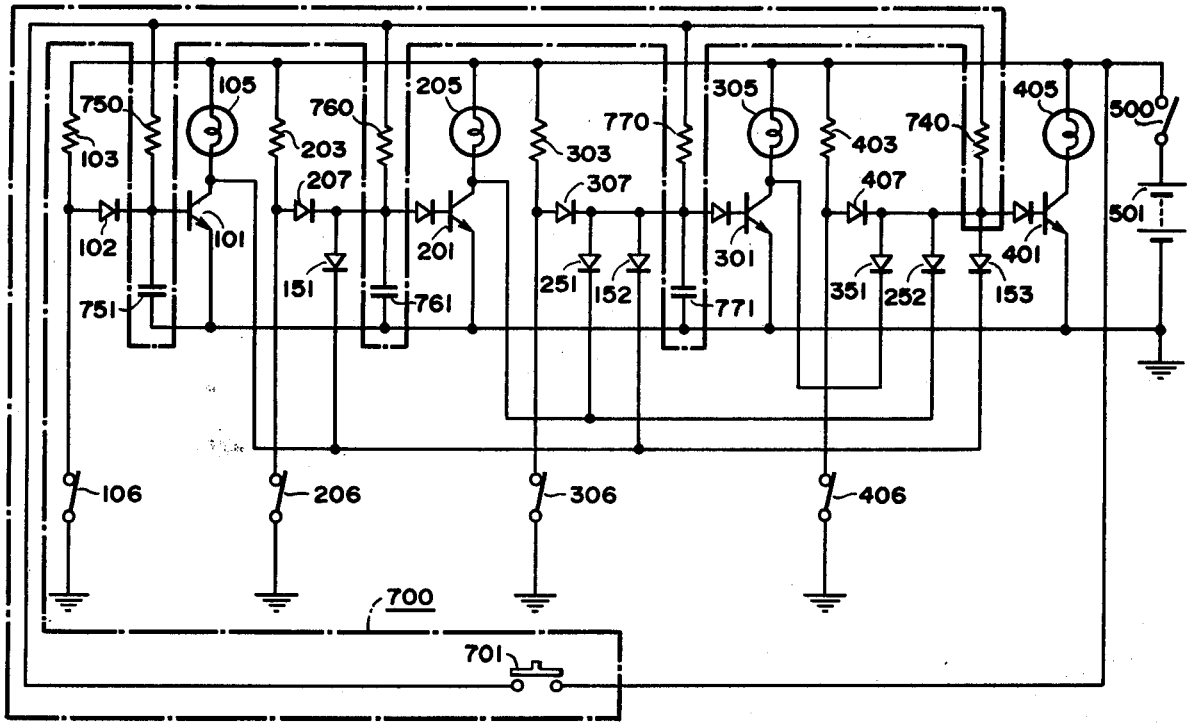
FIG. 10 is a further embodiment of the system.

FIG. 10 is a further embodiment of the invention. Here, the checkup switch is in the form of a timer circuit of FIG. 9, however for simplification of illustration it is shown as a checkup switch 701. The circuit is constructed in a manner that a checkup signaling circuit 700 has been substituted for the aforementioned time delay switching circuits 710, 720, 730 of FIG. 7; the checkup signaling circuit 700 includes resistor-condenser combinations 750/751, 760/761, 770/771, respectively, connected to the bases of the transistors 101, 201, 301. The circuit otherwise is the same as that of FIG. 7, and therefore its description need not be repeated.

The operation of the checkup signaling circuit 700 will now be described. When the checkup switch 701 is turned on, the base of the transistor 401 is supplied with a working voltage thereby to turn on the transistor 401. In this instance, the other transistors 301, 201, 101 are still kept off since the respective base connected condensers 771, 761, 751 have not yet reached the level of a predetermined voltage. Thus, the display lamp 405 first is energized.

Subsequently the condenser 771 is charged to a predetermined voltage, at which time the transistor 301 is turned on and the display lamp 305 is lit up. With this on operation of the transistor 301, the base of the transistor 401 is connected to ground through the diode 351, so that the transistor 401 is turned off, thereby to deenergize the display lamp 405. Again, this diode 351 in the priority assigning diode circuit works in the same way as described earlier with respect to FIG. 7.

Further when the condenser 761 next is charged to a predetermined voltage, the transistor 201 is turned on, the transistor 301 is turned off, the display lamp 205 now assumes a lit condition and lamp 305 is deenergized. Similarly, the display lamp 105 subsequently is lit up. It is of course noted that the time constant factors determined by the RC combinations 750/751, 760/761, and 770/771 have been selected to be progressively increased in order of condensers 771, 761 and 751.

Figure 11:
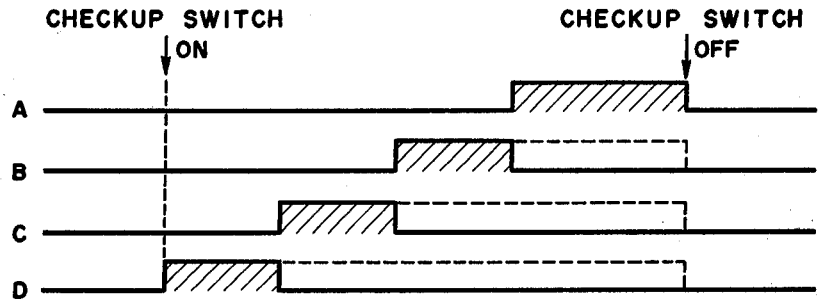
FIG. 11 is a time chart representation of the operational sequence of the system of FIG. 10.

FIG. 11, like FIG. 8, is a wave patterned time chart showing the sequence of operation thus far described, in which waves D, C, B and A respectively represent how the transistors 401, 301, 201 and 101, and display lamps 405, 305, 205 and 105 are to be activated in timed relation; the hatched sections represent the respective display lamps being energized, and the broken line sections show the state of the respective transistors being triggered, but kept restrained from action by the bypass diodes. This pattern is the opposite of that in FIG. 8 with respect to the relative phase. The forward rise of the wave D corresponds to the on position of the checkup switch 701, and the backward rise of the wave A corresponds to the off position of the switch.

The invention has been described in detail and is advantageous in that the alarm indication for many different objects is effected in a preset order of functional importance even if two or more objects show abnormalities simultaneously; thus, a misreading or illegibility of the alarm legends in an overlapping display is avoided. Also, a further feature of the invention is that those alarms, which have once been restrained from action because of their lower priority, will be effected immediately upon solution of the pending abnormalities of higher priority. More advantageously, the invention ensures an easy checkup operation for maintenance or fault finding if the circuits of the system have or have not failed. This checkup operation is automatically performed by the step of impressing checkup signals, upon the ignition switch being turned on, to the individual drive circuits in sequence, each for a predetermined length of time, thereby to produce during testing operative conditions of the drive circuits. Economically, the checkup circuit is so designed as to utilize the function of the priority assigning circuit to energize the indicator elements in sequence.

It is to be understood that the invention is in no way limited to the foregoing description but any change, modification or substitution is possible within the scope of the claims.

What is claimed is:

1. An alarm indicating system for indicating abnormalities occurring in specific objects having a functional importance according to a predetermined order of priority, comprising:

a plurality of layered indicator elements having respective alarm legends thereon and light sources connected to a power source;

a plurality of corresponding drive circuit means connected to said respective indicator elements for energizing said light sources;

a plurality of corresponding abnormality detectors connected to said respective drive circuit means for sensing the occurrence of abnormalities in operation of the respective objects;

each of said drive circuit means including a transistor having its collector connected to one of said light sources and its base connected to one of said abnormality detectors;

a priority assigning means connected between each of said drive circuit means for actuating said drive circuit means according to a predetermined order or priority given thereto; and a failure checkup circuit means connected between said power source and said drive circuit means for applying individually checkup signals to said drive circuit means.

2. An alarm indicating system according to claim 1, wherein said failure checkup circuit means includes a manual change over switch to apply the individual checkup signals.

3. An alarm indicating system for indicating abnormalities occurring in specific objects having a functional importance according to a predetermined order of priority, comprising:

a plurality of layered indicator elements having respective alarm legends thereon and light sources connected to a power source;

a plurality of corresponding drive circuit means connected to said respective indicator elements for energizing said light sources;

a plurality of corresponding abnormality detectors connected to said respective drive circuit means for sensing the occurrence of abnormalities in operation of the respective objects;

a priority assigning means connected between each of said drive circuit means for actuating said drive circuit means according to a predetermined order of priority given thereto; and a failure checkup signaling circuit means connected between said power source and said drive circuit means for applying checkup signals to said drive circuit means to actuate said circuit means successively each for a predetermined length of time and according to predetermined order or priority given thereto, said checkup signaling circuit means including time delay switching circuits connected to said drive circuit means and a checkup switch means to activate said switching circuits.

4. An alarm indicating system according to claim 3, wherein each of said drive circuit means includes a transistor having its collector connected to one of said light sources and its base connected to one of said abnormality detectors.

5. An alarm indicating system according to claim 3, wherein said priority assigning means includes bypass diodes respectively connecting the inputs of said drive circuit means of lower priority to the outputs of said drive circuit means of higher priority.

6. An alarm indicating system according to claim 3, wherein said checkup switch means is a push button type switch for supplying current to said time delay switching circuits; and each of said time delay switching circuits includes a transistor having its collector connected to an input of one of said drive circuit means, and an RC time constant circuit; said RC time constant circuits having respective time constant factors which differ from each other according to the predetermined order of priority given to said drive circuit means.

7. An alarm indicating system according to claim 3, wherein said checkup switch means is a timer circuit having an RC time constant circuit for actuating said time delay switching circuits for a predetermined length of time.

8. An alarm indicating system according to claim 3, wherein said checkup switch means is a timer circuit having an RC time constant circuit for actuating said time delay switching circuits for a predetermined length of time; and each of said time delay switching circuits includes a resistor-condenser circuit connected to the input of one of said drive circuit means, said resistor-condensor circuits having respective time constant factors which differ from one another according to the predetermined order of priority given to said drive circuit means.

9. An alarm indicating system for indicating abnormalities occurring in specific objects having a functional importance according to a predetermined order of priority, comprising:

a plurality of layered indicator elements having respective alarm legends thereon and light sources connected to a power source;

a plurality of corresponding drive circuit means connected to said respective indicator elements for energizing said light sources;

a plurality of corresponding abnormality detectors connected to said respective drive circuit means for sensing the occurrence of abnormalities in operation of the respective objects;

a priority assigning means connected between each of said drive circuit means for actuating said drive circuit means according to a predetermined order or priority given thereto, said priority assigning means including bypass diodes respectively connecting inputs of said drive circuit means of lower priority to outputs of said drive circuit means of higher priority; and a failure checkup circuit means connected between said power source and said drive circuit means for applying individually checkup signals to said drive circuit means.

10. An alarm indicating system according to claim 9, wherein said failure checkup circuit means includes a manual change over switch to apply the individual checkup signals.

* * * * *